US006712750B2

(12) United States Patent
Hayasaka et al.

(10) Patent No.: US 6,712,750 B2
(45) Date of Patent: Mar. 30, 2004

(54) SWINGING BUCKET CENTRIFUGE WITH TAPERED ROTOR PINS

(75) Inventors: Hiroshi Hayasaka, Hitachinaka (JP); Yukiyoshi Maehara, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 272 days.

(21) Appl. No.: 09/970,887

(22) Filed: Oct. 5, 2001

(65) Prior Publication Data

US 2002/0048515 A1 Apr. 25, 2002

(30) Foreign Application Priority Data

Oct. 6, 2000 (JP) ..... 2000-307019

(51) Int. Cl.[7] ..... B04B 5/02
(52) U.S. Cl. ..... 494/20
(58) Field of Search ..... 494/12, 20, 21, 494/33, 83, 85; 74/572

(56) References Cited

U.S. PATENT DOCUMENTS

| | | | | | |
|---|---|---|---|---|---|
| 2,604,261 | A | * | 7/1952 | Silverstolpe | 494/20 |
| 3,028,075 | A | * | 4/1962 | Blum | 494/20 |
| 3,722,791 | A | * | 3/1973 | Wright | 494/20 |
| 3,762,635 | A | * | 10/1973 | Hankey | 494/20 |
| 4,009,824 | A | * | 3/1977 | Wright | 494/20 |
| 4,141,489 | A | * | 2/1979 | Wright | 494/20 |
| 4,147,294 | A | * | 4/1979 | Davidson et al. | 494/20 |
| 4,314,662 | A | * | 2/1982 | Uchida | 494/20 |
| 4,314,663 | A | * | 2/1982 | Ouchi | 494/16 |
| 4,344,563 | A | * | 8/1982 | Romanauskas | 494/20 |
| 4,548,596 | A | * | 10/1985 | Sutton et al. | 494/20 |
| 5,681,258 | A | * | 10/1997 | Lowe et al. | 494/20 |
| 5,816,998 | A | * | 10/1998 | Silverstolpe et al. | 494/19 |

FOREIGN PATENT DOCUMENTS

| | | | |
|---|---|---|---|
| DE | 2900121 A1 | * | 7/1980 |
| JP | 49-15066 | * | 2/1974 |
| JP | 63-2110 | * | 1/1988 |
| JP | 63-35797 | * | 9/1988 |
| JP | 6-285390 | * | 10/1994 |
| JP | 8-108097 | * | 4/1996 |
| JP | 2000-24550 | * | 1/2000 |
| JP | 2002-316070 | * | 10/2002 |

* cited by examiner

*Primary Examiner*—Charles E. Cooley
(74) *Attorney, Agent, or Firm*—McDermott, Will & Emery

(57) ABSTRACT

A swing rotor for centrifugal machines is provided. The rotor comprises a rotor body around which plural arms are disposed. A through hole is formed in place through each arm. Plural buckets are arranged around the rotor body so as to be swingable between two arms. Each rotor pin is inserted through each through hole to be arranged in a direction of a normal line to a rotation axis of the rotor body, so that two buckets are swingably supported by both ends of each rotor pin. Each end of the rotor pin is shaped into an outwardly extended taper form having a predetermined taper angle made to a center axis of each rotor pin. The taper angle is substantially equal to an angle made between a swinging axis of each bucket and the center axis of each rotor pin. This reduces failures in swing motions of the buckets.

8 Claims, 7 Drawing Sheets

SWINGING BUCKET CENTRIFUGE WITH TAPERED ROTOR PINS

BACKGROUND OF THE INVENTION

1. Field of the Invention

The present invention relates to a rotor for machines such as centrifugal machines, and in particular, to the rotor of which swinging functions of buckets are surely prevented from being slid.

2. Related Art

There are various kinds of swing rotor for centrifugal machines. Of these, a conventional swing rotor generally includes buckets, into which a specimen is put, and cylindrical rotor pins each serving as a fulcrum for the bucket. Each rotor pin is attached to each side of each bucket and connected to each arm of the rotor, so that the bucket can be swung about the rotor pin.

The rotor pins are arranged in parallel to the center axis for swinging of the bucket, and in many cases, fixed to either the rotor or the bucket. The rotation of the rotor generates a centrifugal force that permits each bucket to swing with its bottom gradually shifted outward and lifted. At a pin-supporting portion of each bucket, there occur sliding motions between the rotor pin and the inner wall of the pin-supporting portion when the bucket swings. Therefore, in order to ensure that the swing motion is carried out with precision and stability, a lubricant or other anti-sliding materials must be applied to the portion at shorter and regular intervals.

The number of buckets is mostly even, and in most cases, 4 or less. When both sides of the bucket are supported by the rotor pins, a lateral hole must be bored into both sides of each arm part of the rotor, so that the bucket can be attached to the rotor. However, the number of buckets is large (for example, 6 or more), a bucket-arrangement angle relatively made to a certain adjacent bucket becomes smaller, so the space between the two mutually adjacent buckets is narrowed. Accordingly, a lateral boring work to the sides of the arm becomes difficult, limiting the choices of how to attach the rotor pin.

To overcome such a situation, one measure is that the rotor pin is attached to the bucket to be supported by each arm of the rotor. Another measure is illustrated in FIG. 1, in which reference numerals 5, 6 and 7 show a bucket, a pin portion attached to a rotor body, and an arm extended from the rotor body, respectively. In this configuration, the pin portions 6 are integrally formed with the arms 7 by means of casting or the like. Each bucket 5 is hooked up at both the pin portions 6 each projected inward from given upper parts of each arm 7. For the sake of an easier understanding. FIG. 1 is drawn with one bucket 5 omitted Alternatively, for only a narrow spacing is left between adjacent two buckets, adjacent two rotor pins are made integrally as one pin and both tips of the integral pin are bent at a certain angle that agrees with an angle between the pin's axial direction and a swinging axis direction. Such pin is fixed in place to each arm, so that the buckets can be swung.

As mentioned above, in the conventional swing rotor, there occur sliding motions in the contact between the rotor pin and the pin-supporting portion of the bucket. Though the bucket should return to its original standing-up position when the rotor stops rotating, there are some cases in which the bucket stops by friction before it returns to the original standing-up position. Especially, in the case of an automatic centrifugal machine that automatically charges and discharges a specimen into and from the bucket, such incomplete return of the bucket to the its original position will lead to various serious situations. For example, no specimen will be automatically discharged from the bucket if such incomplete return really happens. What is worse, a stop of the rotor and/or damages of a specimen and the machine may be caused. To avoid such undesired situations requires that grease or other materials for lubrication be applied frequently to the pin-supporting portions. However, there is an inconvenience that this application needs much work.

SUMMARY OF THE INVENTION

An object of the present invention is to solve the above problems, that is, to maintain a simplified structure of the rotor in which a large number of buckets are arranged, while eliminating incomplete swinging motions of the buckets and to reduce the number of times of regular maintenance, thereby improving reliability of a machine in which a specimen is automatically charged and discharged into and from the buckets.

In order to accomplish the above object, the present invention is basically provided by a rotor used for a centrifugal machine and the rotor comprises a rotor body, a plurality of buckets, and a plurality of rotor pins. The rotor body is driven to rotate, the rotor body having a plurality of arms around the rotor body. A hole is formed in place in each arm. The plurality of buckets are arranged around the rotor body so as to be swingable between any two of the arms. The plurality of rotor pins are each inserted through each of the holes and arranged in a direction of a normal line to a rotation axis of the rotor body so as to swingably support any two of the buckets by both ends of each rotor pin. Each of both the ends is shaped into a tapered form having a predetermined taper angle and extending in diameter outwardly to an axis of the rotor pin.

Preferably, the taper angle given to each end of each rotor pin is at least substantially equal to an angle made between a swinging axis of each bucket and a center axis of each rotor pin. It is particularly preferred that the taper angle is substantially equal to the angle made between the swinging axis of each bucket and the center axis of each rotor pin.

Still preferably, any two of the buckets supported are mutually adjacent two buckets with any one of the arms located therebetween.

It is also preferred that each rotor pin is rotatable to each arm.

Further it is preferred that an accepting portion for each rotor pin formed in each bucket is a cylindrical hole of which diameter is larger than an outermost diameter of each tapered end of the rotor pin.

Thus, during the rotation of the rotor body that causes a centrifugal force, each tapered end of the rotor pin is brought into contact with the inner wall of the hole of each bucket under a line contact. This line contact makes swinging motions of the buckets smooth, thus avoiding an incomplete return of each bucket to its original standing-up position. The smooth and stable swinging motions of the buckets eliminate the necessity of applying grease to the rotor pins so often. Any particular parts are not added to the rotor, so the simplified construction of the rotor is still maintained.

DETAILED DESCRIPTION OF THE PREFERRED EMBODIMENTS

Referring to FIGS. 2 to 5, one embodiment of a rotor according to the present invention will now be described. This rotor is dedicated to a centrifugal machine.

Figure 1:
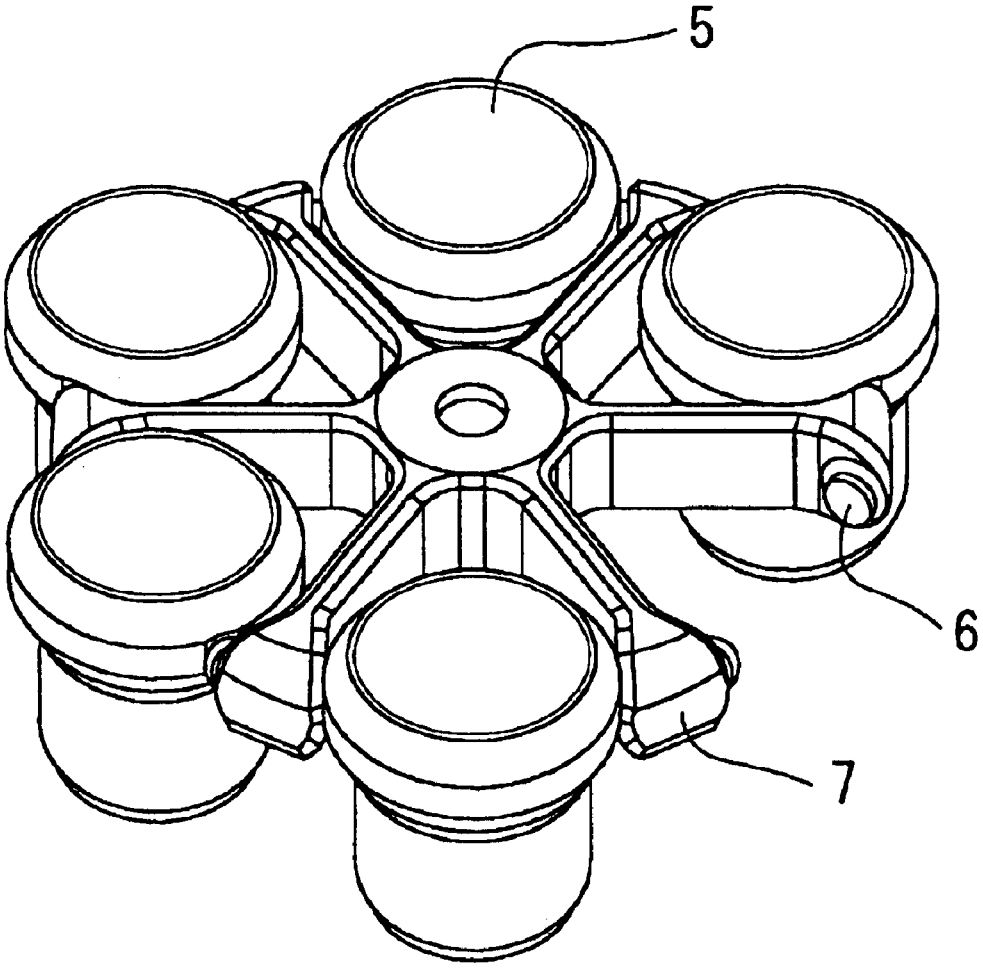
FIG. 1 PRIOR ART
FIG. 1 is a perspective view of a conventional rotor body with a plurality of buckets part of which is omitted from being drawn.
Figure 2:
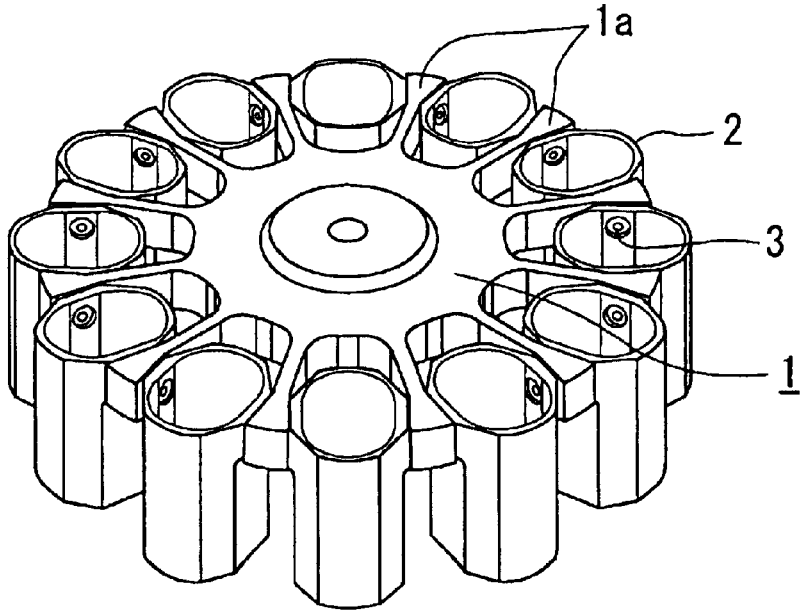
FIG. 2 shows a perspective view of part of a swing rotor according to the present invention, which includes a rotor body provided with a plurality of buckets.
Figure 3:
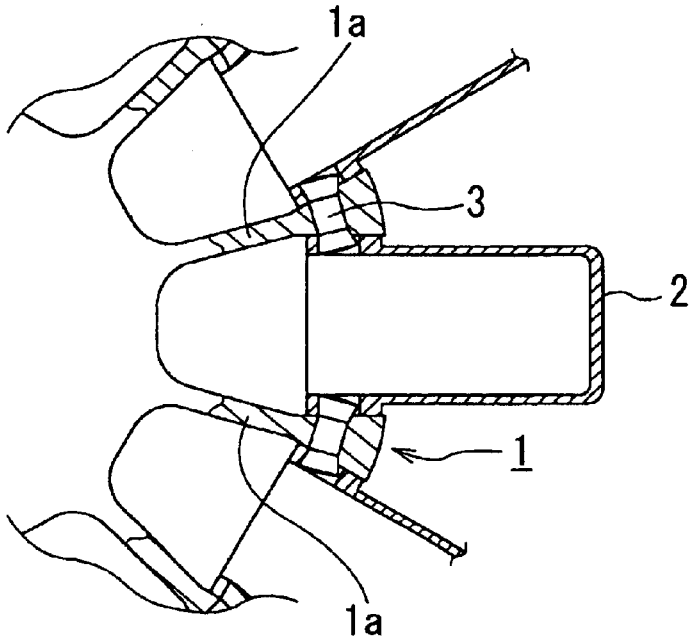
FIG. 3 is a partially sectioned top view of the rotor body, in which the buckets have been swung by a centrifugal force during the rotation of the rotor.
Figure 4:
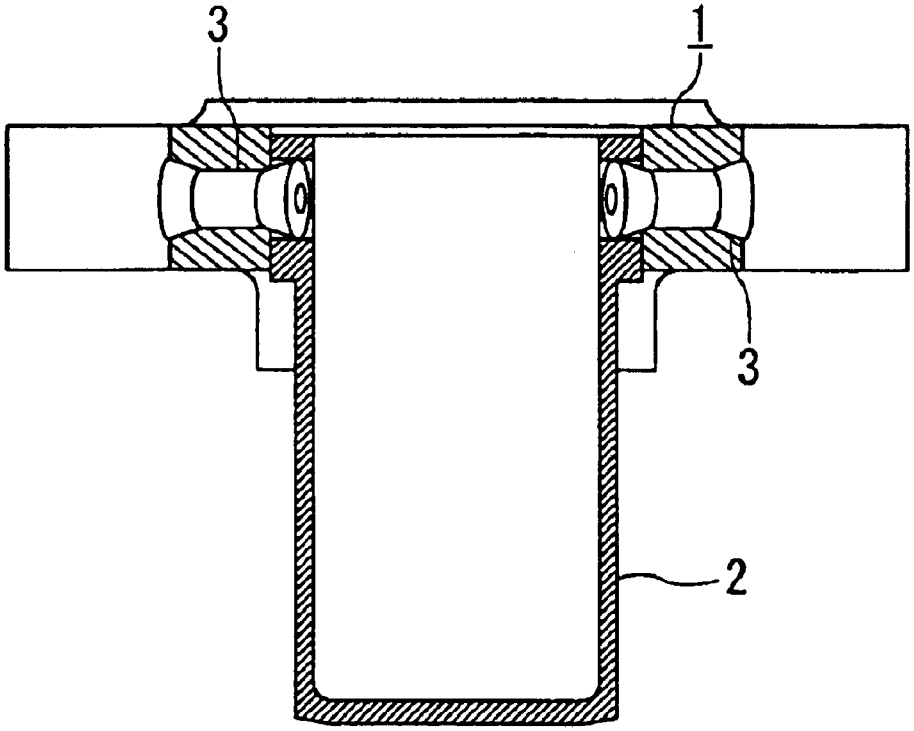
FIG. 4 shows a longitudinally sectioned view of one bucket, which is under rest at its initial non-swing position when the rotor is not driven.

FIG. 2 shows a perspective view of part of a swing rotor of a centrifugal machine, the swing rotor including a rotor body 1 provided with a plurality of buckets 2. The rotor body 1 shown in FIG. 2 is under rest with no rotation. FIG. 3 is a partially sectioned top view of the rotor body 1, in which the buckets 2 have been swung by a centrifugal force. In addition, FIG. 4 shows a longitudinally sectioned view of one bucket 2, which is under rest at its initial non-swing position because no centrifugal force is generated.

As shown in FIG. 2, twelve box-like buckets 2 are arranged around the rotor body 1. When a drive unit (not shown) revolves the rotor body 1, each bucket 2 is swung about its swing axis supported by a pair of rotor pins 3 each described later, so that the bucket 2 is rotated outwardly, as shown in FIG. 3.

The rotor body 1 has twelve arms 1*a* each extending outwardly, and the outward end of the arm 1*a* is widened gradually to form an approximately inverted wedge shape, when being viewed from the top. In this embodiment, the wedge-shaped end has a tapered side surface 1*c* of which taper angle to the longitudinal direction of each arm 1*a* (i.e., the radial direction of the rotor body 1) is set to θ 2 (refer to FIG. 5). This amount of the taper angle θ 2 will be described later.

Each arm 1*a* has a through hole 1*b* formed in place in the lateral direction. Each rotor pin 3 is rotatably inserted through the through hole 1*b*, and both ends thereof supports any two adjoining buckets 2 arranged at both sides of each arm 1*a*, so that each bucket 2 can be swung around its swinging axis B (refer to FIG. 5).

In the present embodiment, the arms 1*a*, rotor pins 3, and buckets 2 are produced from metal materials, but those elements may also be produced from plastic materials, such as FRP (Fiber Reinforced Plastics)or CFRP (Carbon Fiber Reinforced Plastics).

A total of 12 rotor pins 3 are arranged through the 12 arms 1*a*, respectively, such that each rotor pin 3 is directed along the perpendicular direction to the rotation axis of the rotor body 1.

Figure 5:
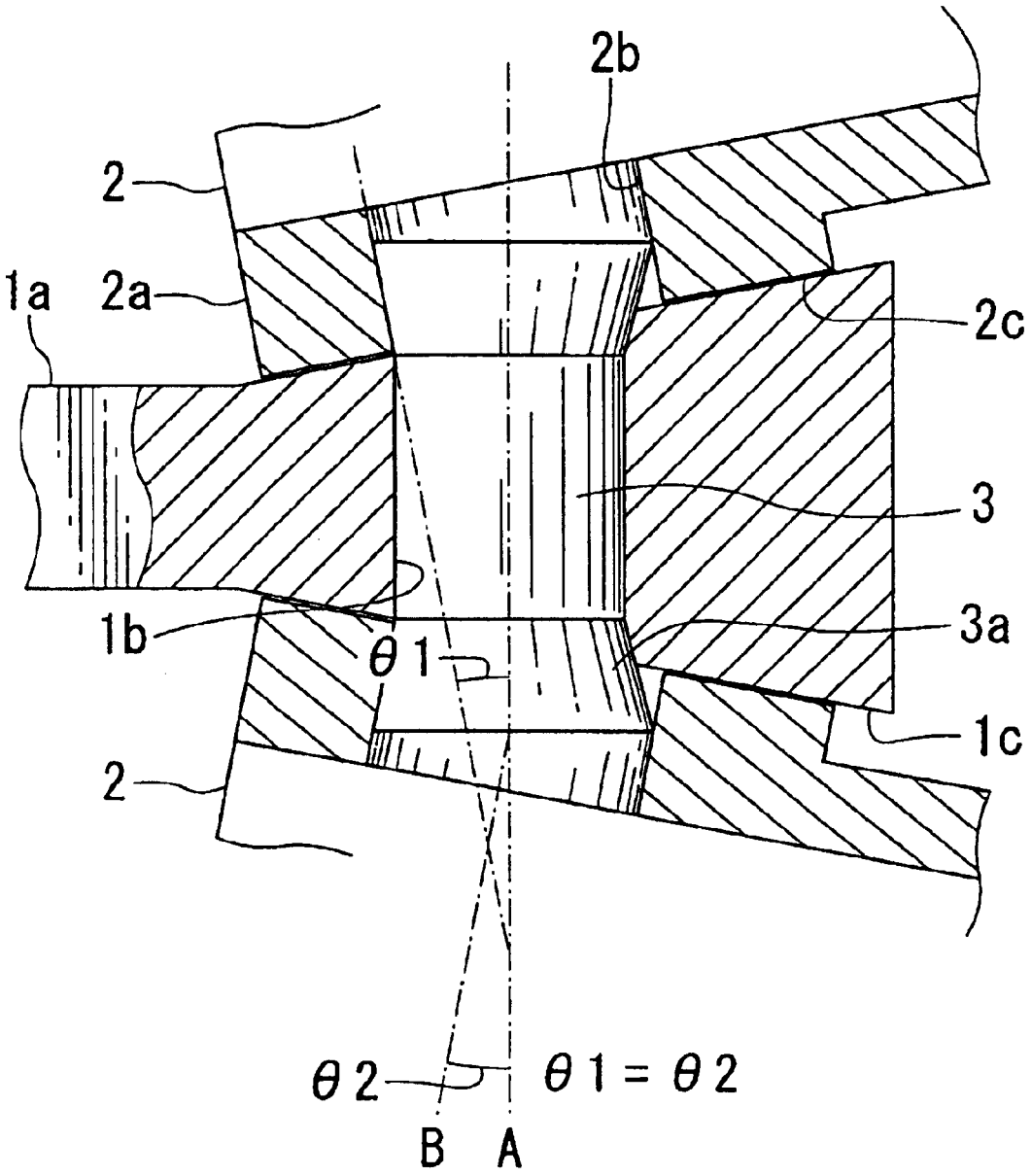
FIG. 5 is an enlarged view illustrating the coupling relationship among the rotor body, one bucket that has been swung, and one rotor pin.

Each of both ends of each rotor pin 3 is formed into a tapered shape of which diameter becomes large as its axis advances outwardly. In the present invention, as illustrated in FIG. 5, the taper angle θ 1 made to a center axis A of each rotor pin 3 is approximately equal to an angle θ 2 made between the center axis A and the swinging axis B of each bucket 2. However, such taper angle θ 1 may be defined as an amount larger than the angle θ 2.

Two protrusions 2*a* are integrally built on both upper sides of each bucket 2 so as to face to each other with the bucket's bore therebetween. A cylindrical pin-holding hole 2*b* is formed through each of the protrusions 2*a* so that the hole 2*b* is perpendicular to the wall of each bucket 2. Each of the tapered ends 3*a* of each rotor pin 3 is obliquely inserted in each cylindrical pin-holding hole 2*b*.

Thus, during the rotation of the rotor body 1 that causes a centrifugal force, each tapered end 3*a* of the rotor pin 3 is brought into a line contact with the wall surface of the pin-holding hole 2*b*, as shown in FIG. 5. Because the taper angle θ 1 is approximately equal to an angle θ 2, the tapered surface of each tapered end 3*a* becomes parallel with the wall surface of each pin-holding hole 2*b* and comes in contact with the wall via a line. The centrifugal force that is applied to each bucket 2 is borne through the line contact.

An outer surface 2*c* of each of the protrusions 2*a* and each tapered side surface 1*c* of the arm 1*a*, which are faced to each other, are parallel to each other. This parallel-surface structure prevents each bucket 2 from being shifted in the lateral direction. Actually, though not shown, some element such as a spacer, which reduces contact to the arm 1*a*, is disposed on either outer surface 2*c* or 1*c*.

As shown in FIG. 4, each bucket 2 is at rest at its original standing-up position while the rotor body 1 remains stationary. In such case, each bucket 2 is supported by only an upper point of each tapered end 3*a* of each of the two neighboring rotor pins 3, because the taper angle θ 1 is approximately equal to an angle θ 2. Therefore, as long as the rotor body 1 is stationary, each bucket 2 comes into a point contact with each rotor pin 3, minimizing contact against the swing motion of each bucket 2, with less frictional force. Accordingly, the swing motions of the buckets 2 are made smooth, reducing their poor swing motions down to a minimum.

In place of the taper angle defined in the above embodiment, if considering enhancement of only the advantages resulting from the swing motion, the taper angle may be set to larger amounts than the above. Such lager amounts enable a point contact made between each bucket and each rotor pin 3 even during the rotation of the rotor body 1. However, some centrifugal states are supplied by the rotation of higher speeds, where a centrifugal force applied to the bucket 2 is greater. It is therefore preferable that the contact be sustained by as larger areas as possible, such as a line contact, so as to lower surface pressure. Since each rotor pin 3 supports two buckets 2 at its both ends, those ends receive forces. Accordingly, moment applied to the rotor pin 3 can be smaller, reducing local stresses applied to the rotor body 1.

Figure 6:
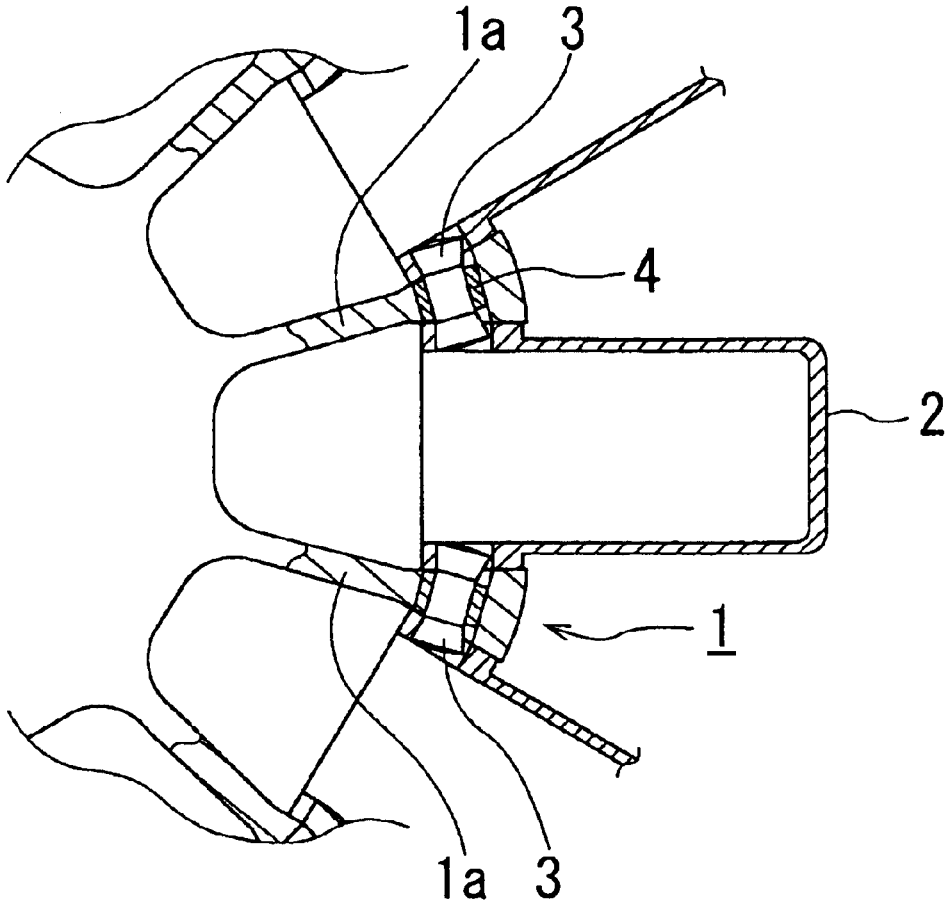
FIG. 6 is a partially sectioned top view of a rotor body according to a modification of the present invention, in which a bearing is mounted to each arm of the rotor body to bear the rotor pin.

FIG. 6 shows a modification of the present invention, in which a swing rotor for a centrifugal machine is provided. The configuration in FIG. 6 shows coupling of the rotor pin 3 with the rotor body 1, in which a half bearing 4 is inserted between the rotor pin 3 and the rotor body 1. Although the coupling structure described in the foregoing embodiment of FIGS. 2 to 5 maintains the minimum contact area between each rotor pin 3 and each bucket 2, there is still a room for sliding therebetween. Therefore, in order to prevent this sliding almost completely, the structure of FIG. 6 is provided, in which the bearing 4 allows the rotor pin 3 to rotate freely. Because the rotor pin 3 is formed into a symmetric shape about its center axis, the rotation of the rotor pin 3 itself has no influence on the arrangement of the bucket 2. The sliding which remains between each bucket 2 to each rotor pin 3 can be suppressed, without fail, by the rotation of the rotor pin 3 thanks to the bearing 4.

Figure 7:
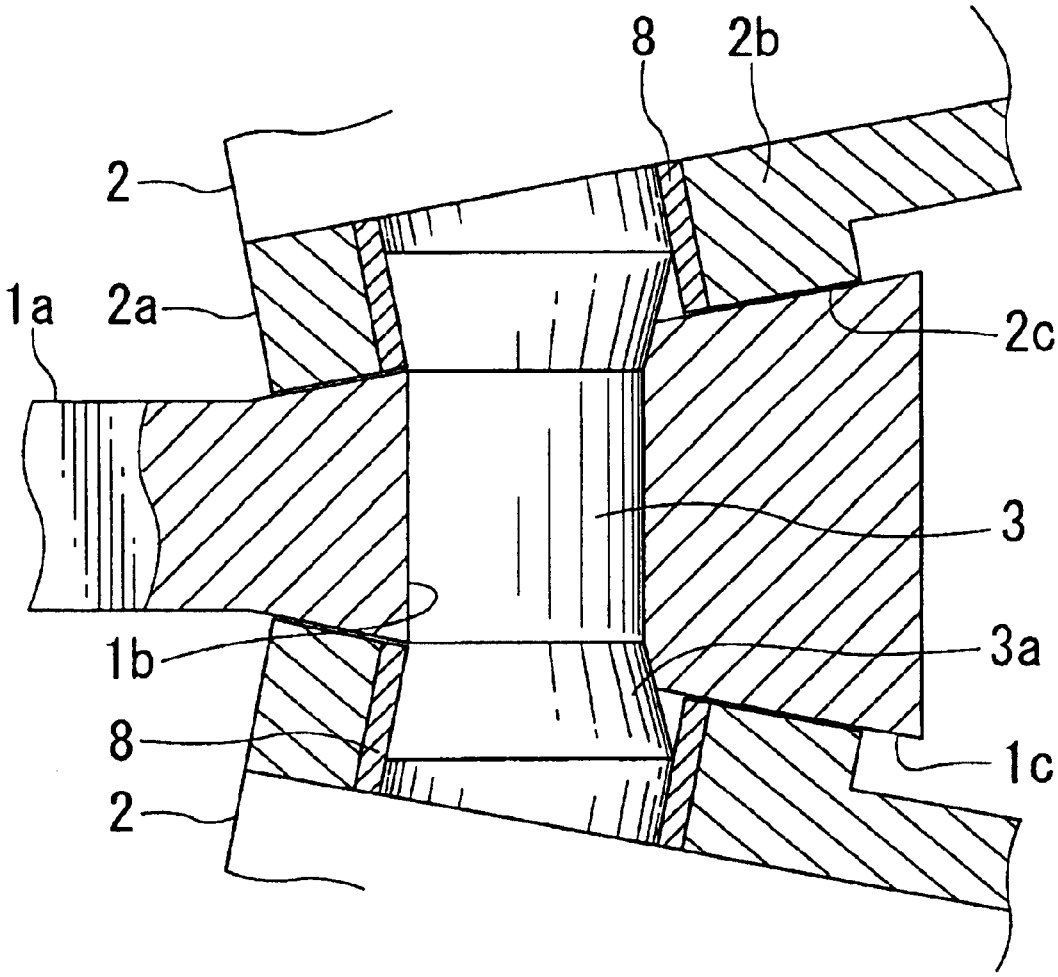
FIG. 7 is a partially sectioned top view of a rotor body according to a further modification of the present invention, in which a second bearing is mounted to each bucket to bear the rotor pin.

A second modification is shown in FIG. 7, which represents addition of a second bearing 8 mounted on each pin-holding hole 2*b* of each bucket 2 so as to rotatably bear each tapered end 3*a* of each rotor pin 3. The bearing 8 enables the rotor pin 3 to rotate for a certainty, thus preventing the sliding between the bucket 2 and the rotor pin 3, thus allowing the rotor pin 3 to rotate freely, like the foregoing bearing 4 shown in FIG. 6. This mounting of the bearing 8 may be solely or added to the structure that uses the bearing 4 shown in FIG. 6.

Figure 8:
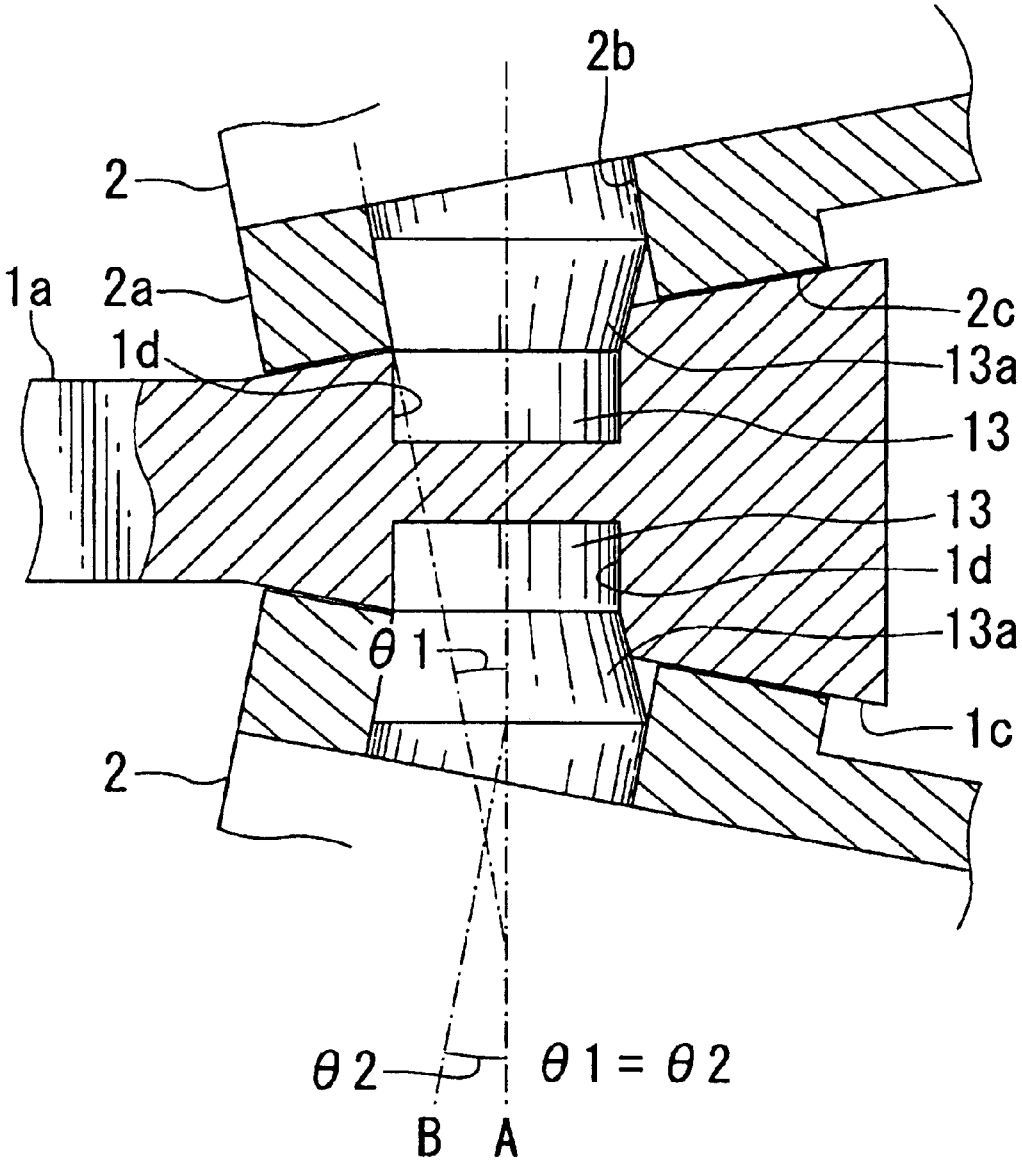
FIG. 8 is a partially sectioned top view of a rotor body according to another modification of the present invention, in which two bottomed openings are formed in both sides of each arm to have two rotor pins interfitted in the openings.

A third modification is shown in FIG. 8, which represents a structure for attaching the rotor pin to each arm. In this structure, each rotor pin shown in the foregoing embodiment and modifications is divided into two pieces 13. Only one end of each rotor pin 13 is formed into a tapered end 13*a* having a tapered surface of which taper angle to the center axis A thereof is θ 1, while the other end is formed into a cylindrical body shorter in length than that shown in the foregoing embodiment.

To secure each rotor pin 13, instead of the foregoing through hole 1*b*, two bottomed openings 1*d* are drilled back to back in each wedge-shaped end so as to open from both tapered side surfaces 1*c*, respectively. The bottomed openings 1*d* have the same function as the foregoing through hole 1*b*, so included in the hole of the present invention.

The cylindrical body of each rotor pin 13 is interfitted in each bottomed opening 1*d*, with the tapered end thereof put into the pin-holding hole 2*b*, as shown in FIG. 8. Like the foregoing embodiment, the taper angle θ 1 of the tapered end 13*a* of each rotor pin 13 is substantially equal to the angle θ 2 made between the swinging axis B of each bucket 2 and the center axis A passing two rotor pins 13 arranged at both sides of one arm 1*a*. Therefore, the identical functions and advantages to those described in the foregoing embodiment are obtained as well in this modified fitting structure.

In addition, the second bearings 8 that have been described in FIG. 7 are also applicable to the pin-holding hole 2*b* in FIG. 8.

Though not described in particular about how to attach the rotor pin 3, a groove through which the rotor pin 3 passes is formed on the upper surface of the rotor body 1. In cases the bucket 2 should not be allowed to be taken off, as seen in an automatic centrifugal machine, a lid member may be mounted to close the groove, thus the rotor pin 3 being kept with the rotor body 1. The bucket 2 is prevented from taking off. Furthermore, each pin-holing hole 2*b* according to the foregoing embodiment is formed by drilling each protrusion 2*a* formed on each side of the bucket 2, but this hole 2*b* can further be modified. By way of example, as in conventional, the lower side of the pin-holding hole 2*b* can be opened in part to form an aperture, so that the bucket 2 is detachable via the aperture.

As described so far. by the foregoing embodiment and its various modifications, it is possible to greatly reduce failures in swings of the swing rotor. Hence the grease-up work to the rotor pins, which was frequently required as maintenance by the conventional, can be lessened. Accordingly, system down states or other inconveniences due to poor swinging performances of an automatic centrifugal machine can be reduced to a minimum, thereby raising reliability in operating the machine.

For the sake of completeness, it should be mentioned that the embodiments shown in the figures are not definitive lists of possible embodiments. The expert will appreciate that it is possible to combine the various construction details or to supplement or modify them by measures known from the prior art without departing from the basic inventive principle.

What is claimed is:

1. A rotor used for a centrifugal machine, comprising:

a rotor body to be driven to rotate, the rotor body having a plurality of arms around the rotor body, a hole being formed in place in each arm;

a plurality of buckets arranged around the rotor body so as to be swingable between any two of the arms, and a plurality of rotor pins each inserted through each of the holes and arranged in a direction of a normal line to a rotation axis of the rotor body so as to swingably support any two of the buckets by both ends of each rotor pin, each of both the ends being shaped into a tapered form having a predetermined taper angle and extending in diameter outwardly to an axis of the rotor pin.

2. The rotor according to claim 1, wherein the taper angle given to each end of each rotor pin is at least substantially equal to an angle made between a swinging axis of each bucket and a center axis of each rotor pin.

3. The rotor according to claim 1, wherein any two of the buckets supported are mutually adjacent two buckets with any one of the arms located therebetween.

4. The rotor according to claim 1, wherein each rotor pin is rotatable to each arm.

5. The rotor according to claim 4, wherein a divided bearing member is placed between the rotor pin and the arm.

6. The rotor according to claim 1, wherein an accepting portion for each rotor pin formed in each bucket is a cylindrical hole of which diameter is larger than an outermost diameter of each tapered end of the rotor pin.

7. The rotor according to claim 1, wherein a bearing member is placed in a accepting portion for each rotor pin formed in each bucket so that the bearing member bears each tapered end of the rotor pin.

8. The rotor according to claim 1, wherein the taper angle given to each end of each rotor pin is substantially equal to an angle made between a swinging axis of each bucket and a center axis of each rotor pin.

* * * * *

UNITED STATES PATENT AND TRADEMARK OFFICE

CERTIFICATE OF CORRECTION

PATENT NO. : 6,712,750 B2
DATED : March 30, 2004
INVENTOR(S) : Hiroshi Hayasaka et al.

It is certified that error appears in the above-identified patent and that said Letters Patent is hereby corrected as shown below:

Title page, Item [54] and Column 1, lines 1-2,
Title, change "SWINGING BUCKET CENTRIFUGE WITH TAPERED ROTOR PINS" to -- ROTOR FOR CENTRIFUGAL MACHINE --.

Signed and Sealed this

First Day of November, 2005

JON W. DUDAS
*Director of the United States Patent and Trademark Office*